US007207243B1

(12) United States Patent
Lee

(10) Patent No.: US 7,207,243 B1
(45) Date of Patent: Apr. 24, 2007

(54) CLUTCH TYPE SCREWDRIVER

(75) Inventor: Yu Hao Lee, Taichung County (TW)

(73) Assignee: Meeng Gang Enterprises Co., Ltd., Taichung (TW)

( * ) Notice: Subject to any disclaimer, the term of this patent is extended or adjusted under 35 U.S.C. 154(b) by 0 days.

(21) Appl. No.: 11/295,772

(22) Filed: Dec. 7, 2005

(51) Int. Cl.
*B25B 15/04* (2006.01)
*B25B 13/46* (2006.01)

(52) U.S. Cl. ..... 81/58.3; 81/63.1

(58) Field of Classification Search ..... 81/58, 81/58.3, 58.4, 60, 63.1
See application file for complete search history.

(56) References Cited

U.S. PATENT DOCUMENTS 1,474,798 A * 11/1923 Stark ..... 81/63.2
5,737,982 A * 4/1998 Lin ..... 81/58.3
6,047,617 A * 4/2000 Chen ..... 81/63.1
6,058,812 A * 5/2000 Casel et al. ..... 81/60
6,568,693 B2 * 5/2003 Glass ..... 279/80
6,935,211 B2 * 8/2005 Chen ..... 81/58.4
7,036,398 B2 * 5/2006 Chen ..... 81/58.3
7,055,411 B2 * 6/2006 Huang ..... 81/63.1
2005/0155462 A1 * 7/2005 Chen ..... 81/58.4
2005/0193870 A1 * 9/2005 Chen ..... 81/58.4

* cited by examiner

*Primary Examiner*—David B. Thomas
(74) *Attorney, Agent, or Firm*—Banger Shia

(57) ABSTRACT

A screwdriver includes a clutch mechanism, a handle mounted on a first end of the clutch mechanism, and a replaceable screwdriver tip mounted on a second end of the clutch mechanism. The clutch mechanism includes a mounting seat, an annular sleeve, a positioning member, first and second limit units, a press member, a rotation disk, and a threaded sleeve. Thus, the handle can be rotated to drive the screwdriver tip to rotate in two opposite directions and to rotate in one direction only, thereby facilitating a user operating the screwdriver tip. In addition, the user only needs to rotate the rotation disk to change the operation direction of the screwdriver, thereby facilitating the user operating the screwdriver.

20 Claims, 8 Drawing Sheets

CLUTCH TYPE SCREWDRIVER

BACKGROUND OF THE INVENTION

1. Field of the Invention

The present invention relates to a screwdriver, and more particularly to a clutch type screwdriver.

2. Description of the Related Art

A conventional screwdriver comprises a shank having a first end provided with a tip, and a handle mounted on a second end of the shank. A conventional ratchet type screwdriver is disclosed in U.S. Patent Application No. 2005/0193870A1. Another conventional ratchet type screwdriver is disclosed in the Taiwanese Patent Publication No. 385742, 403020, 578653 and M241178.

SUMMARY OF THE INVENTION

The primary objective of the present invention is to provide a screwdriver, wherein the handle can be rotated to drive the screwdriver tip to rotate in two opposite directions and to rotate in one direction only, thereby facilitating a user operating the screwdriver tip.

Another objective of the present invention is to provide a screwdriver, wherein the user can watch the indicating plate of the annular sleeve through the indication windows of the rotation disk to judge the operation direction of the screwdriver.

A further objective of the present invention is to provide a screwdriver, wherein the user only needs to rotate the rotation disk to change the operation direction of the screwdriver, thereby facilitating the user operating the screwdriver.

A further objective of the present invention is to provide a screwdriver, wherein the first and second limit units are arranged in an axial direction of the mounting seat, thereby greatly saving the space occupied by the first and second limit units.

A further objective of the present invention is to provide a screwdriver, wherein the first and second limit units can limit the operation direction of the screwdriver exactly, thereby facilitating the user operating the screwdriver.

Further benefits and advantages of the present invention will become apparent after a careful reading of the detailed description with appropriate reference to the accompanying drawings.

DETAILED DESCRIPTION OF THE INVENTION

Figure 1:
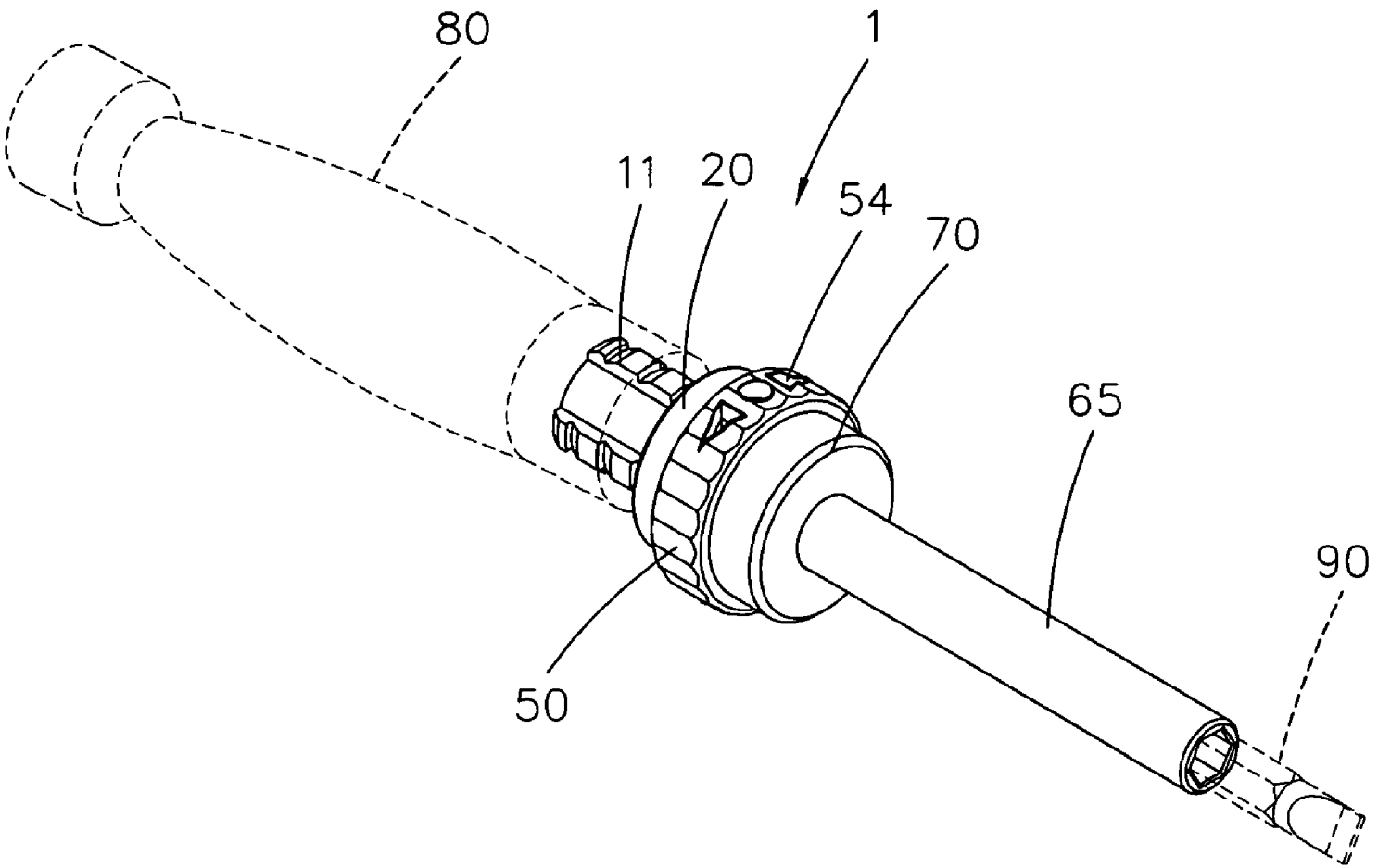
FIG. 1 is a perspective view of a screwdriver in accordance with the preferred embodiment of the present invention.
Figure 2:
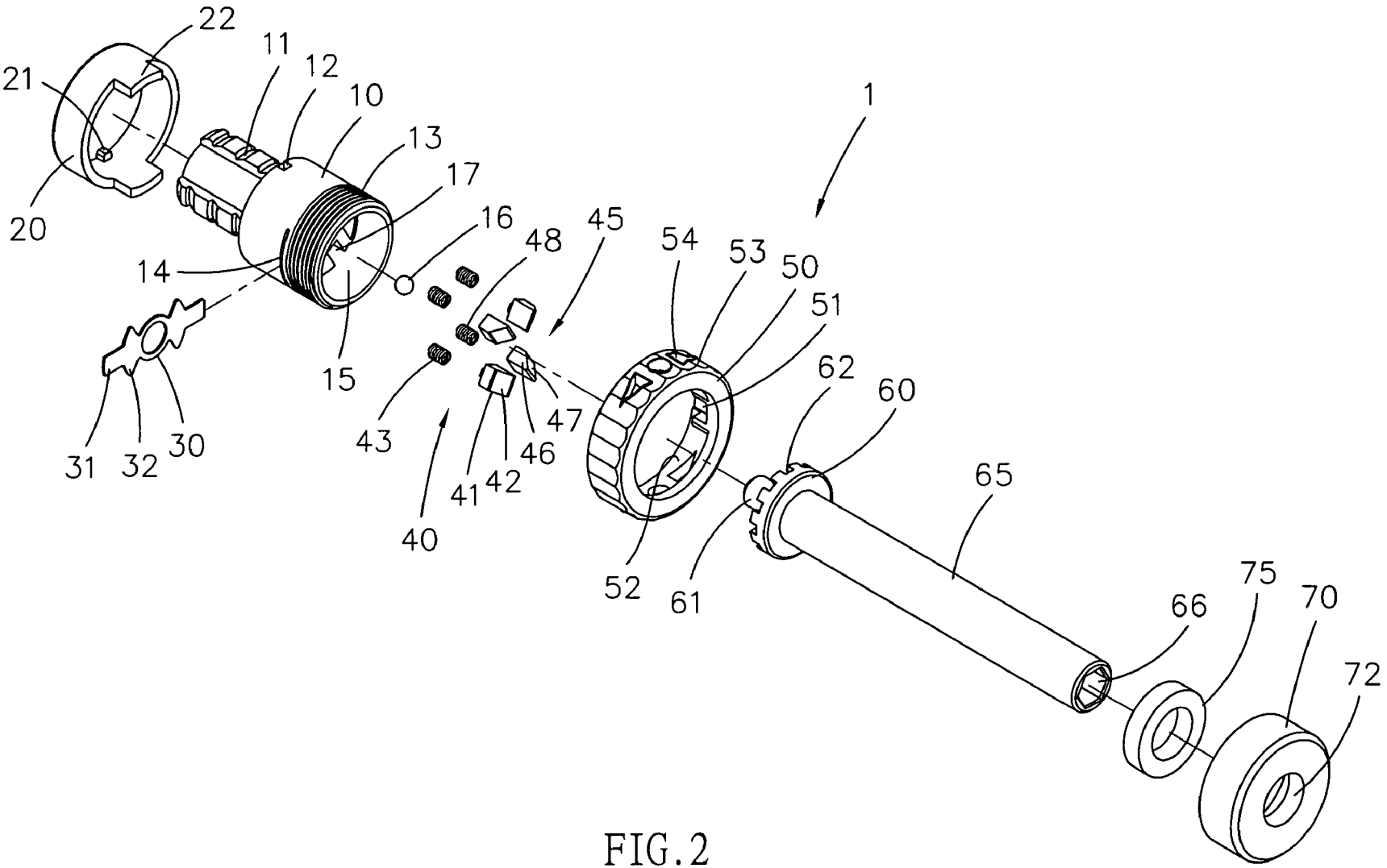
FIG. 2 is an exploded perspective view of the screwdriver as shown in FIG. 1.

Referring to the drawings and initially to FIGS. 1–4, a screwdriver in accordance with the preferred embodiment of the present invention comprises a clutch mechanism 1, a handle 80 mounted on a first end of the clutch mechanism 1, and a replaceable screwdriver tip 90 mounted on a second end of the clutch mechanism 1. The rotation direction of the screwdriver tip 90 is limited by the clutch mechanism 1 so that the screwdriver tip 90 can be operated in one direction only so as to rotate a workpiece, such as a screw or the like.

The clutch mechanism 1 includes a mounting seat 10, an annular sleeve 20, a positioning member 60, first and second limit units 40 and 45, a press member 30, a rotation disk 50, and a threaded sleeve 70.

The mounting seat 10 has an inside formed with a receiving chamber 15. The receiving chamber 15 of the mounting seat 10 has a bottom wall having a central portion formed with a socket 150 (see FIG. 3) and a periphery formed with a plurality of receiving recesses 17. The socket 150 of the mounting seat 10 has a bottom formed with a notch 152. The mounting seat 10 has an end face formed with a serrated mounting portion 11 having a reduced diameter for mounting the handle 80. The end face of the mounting seat 10 has a periphery formed with at least one locking groove 12. The mounting seat 10 has a peripheral wall formed with two radially opposite guide slots 14 and an outer thread 13.

The annular sleeve 20 is mounted on the mounting seat 10 and has a side formed with at least one protruding indicating plate 22 rested on the peripheral wall of the mounting seat 10 to indicate the operation direction of the screwdriver. The annular sleeve 20 has an inner wall formed with at least one locking block 21 inserted into the locking groove 12 of the mounting seat 10 to secure the annular sleeve 20 to the mounting seat 10.

The positioning member 60 is mounted in the receiving chamber 15 of the mounting seat 10 and has a periphery formed with a plurality of positioning grooves 62. The positioning member 60 has a first side formed with a plug 61 inserted into the socket 150 of the mounting seat 10. A ball 16 is mounted in the socket 150 of the mounting seat 10 and located between the plug 61 of the positioning member 60 and the mounting seat 10, so that the positioning member 60 is rotatable smoothly and conveniently. Preferably, the ball 16 is received in the notch 152 of the mounting seat 10. The positioning member 60 has a second side formed with an extension tube 65 having a distal end formed with a hexagonal insertion hole 66 to allow insertion of the screwdriver tip 90.

The first and second limit units 40 and 45 are mounted between the mounting seat 10 and the positioning member 60 and are arranged in a staggered manner. Each of the first and second limit units 40 and 45 includes at least one limit member 41 and 46 movably mounted in the respective receiving recess 17 of the mounting seat 10 and detachably positioned in the respective positioning groove 62 of the positioning member 60, and at least one elastic member 43 and 48 mounted in the respective receiving recess 17 of the mounting seat 10 and each biased between the limit member 41 and 46 and the mounting seat 10 to push the limit member 41 and 46 toward the positioning member 60. The limit member 41 and 46 of each of the first and second limit units 40 and 45 has an oblique guide face 42 and 47. The oblique guide faces 42 and 47 of the first and second limit units 40 and 45 are directed toward different directions.

The press member 30 is a flat plate rotatably mounted in the mounting seat 10. The press member 30 is extended through and rotatably mounted in the guide slots 14 of the mounting seat 10, wherein the rotation angle of the press member 30 is about thirty (30) degrees. The press member 30 has two opposite ends each having a first portion located in the receiving chamber 15 of the mounting seat 10 and formed with at least one outwardly extending press portion 32 that is movable to press the limit member 41 and 46 of each of the first and second limit units 40 and 45. Preferably, the press portion 32 of the press member 30 is movable to press the oblique guide face 42 and 47 of each of the first and second limit units 40 and 45. Each of the two opposite ends of the press member 30 has a second portion protruded outward from the respective guide slot 14 of the mounting seat 10 and formed with an insertion portion 31.

Thus, the press member 30 is rotatable between a first position where the press portion 32 of the press member 30 is detached from the limit member 41 and 46 of each of the first and second limit units 40 and 45 and a second position where the press portion 32 of the press member 30 presses the limit member 41 and 46 of either of the first and second limit units 40 and 45 to detach from the respective positioning groove 62 of the positioning member 60 so as to detach either of the first and second limit units 40 and 45 from the positioning member 60.

The rotation disk 50 is rotatably mounted on the mounting seat 10 and secured to the press member 30 to rotate the press member 30. The rotation disk 50 is located outside of and rotatable relative to the annular sleeve 20. The rotation disk 50 has an inner wall formed with two radially opposite insertion recesses 51 to allow insertion of the insertion portions 31 of the press member 30 to secure the rotation disk 50 to the press member 30. The inner wall of the rotation disk 50 is formed with at least one slideway 52, and the indicating plate 22 of the annular sleeve 20 is slidable in the slideway 52 of the rotation disk 50. The rotation disk 50 has an outer wall formed with a plurality of anti-slip portions 53 to facilitate a user rotating the rotation disk 50. The rotation disk 50 has a periphery formed with a plurality of indication windows 54 extended into the slideway 52 and aligned with the indicating plate 22 of the annular sleeve 20, so that the user can watch the indicating plate 22 of the annular sleeve 20 through the indication windows 54 of the rotation disk 50 to judge the operation direction of the screwdriver.

The threaded sleeve 70 is mounted on the mounting seat 10 and rested on the rotation disk 50 to limit the rotation disk 50 on the mounting seat 10. The threaded sleeve 70 is screwed onto the outer thread 13 of the mounting seat 10. The threaded sleeve 70 has an inside formed with a through hole 72 to allow passage of the extension tube 65 of the positioning member 60.

A bearing 75 is mounted between the positioning member 60 and the mounting seat 10 so that the positioning member 60 is rotatable relative to the mounting seat 10. The bearing 75 is mounted around the extension tube 65 of the positioning member 60 and retained by the threaded sleeve 70 to retain the positioning member 60 in the mounting seat 10.

Figure 3:
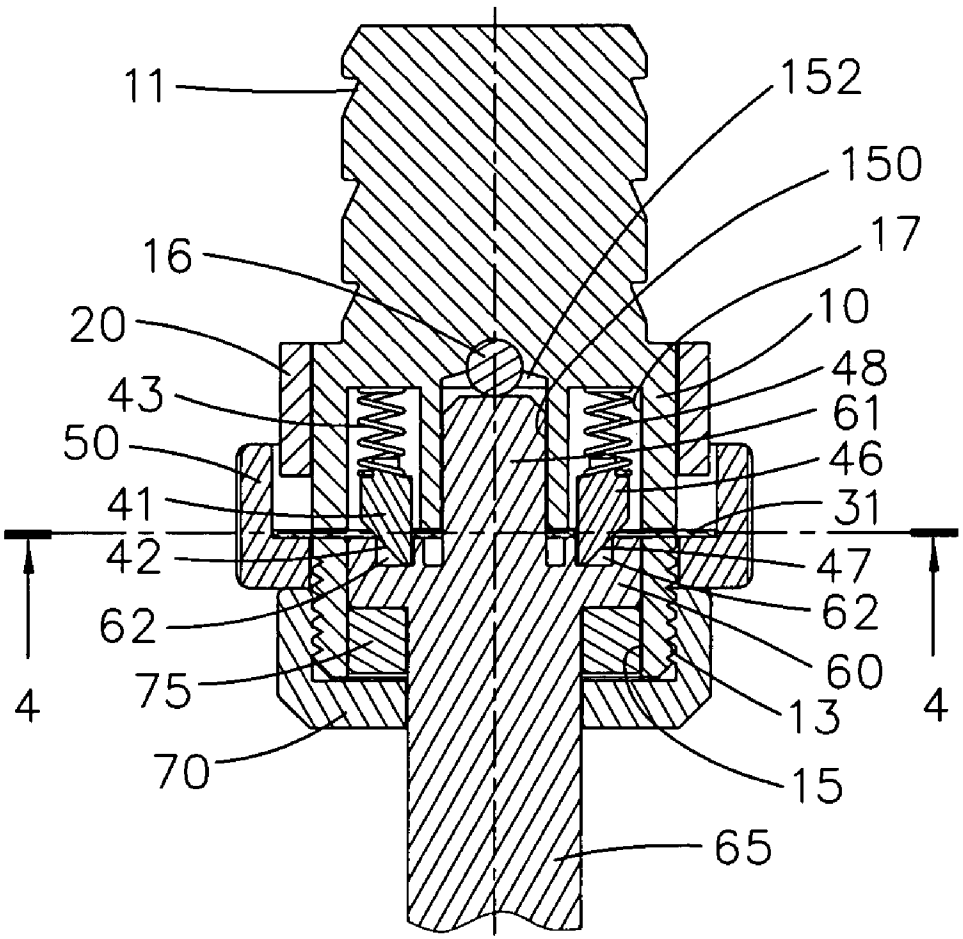
FIG. 3 is a top plan cross-sectional view of the screwdriver as shown in FIG. 1.
Figure 4:
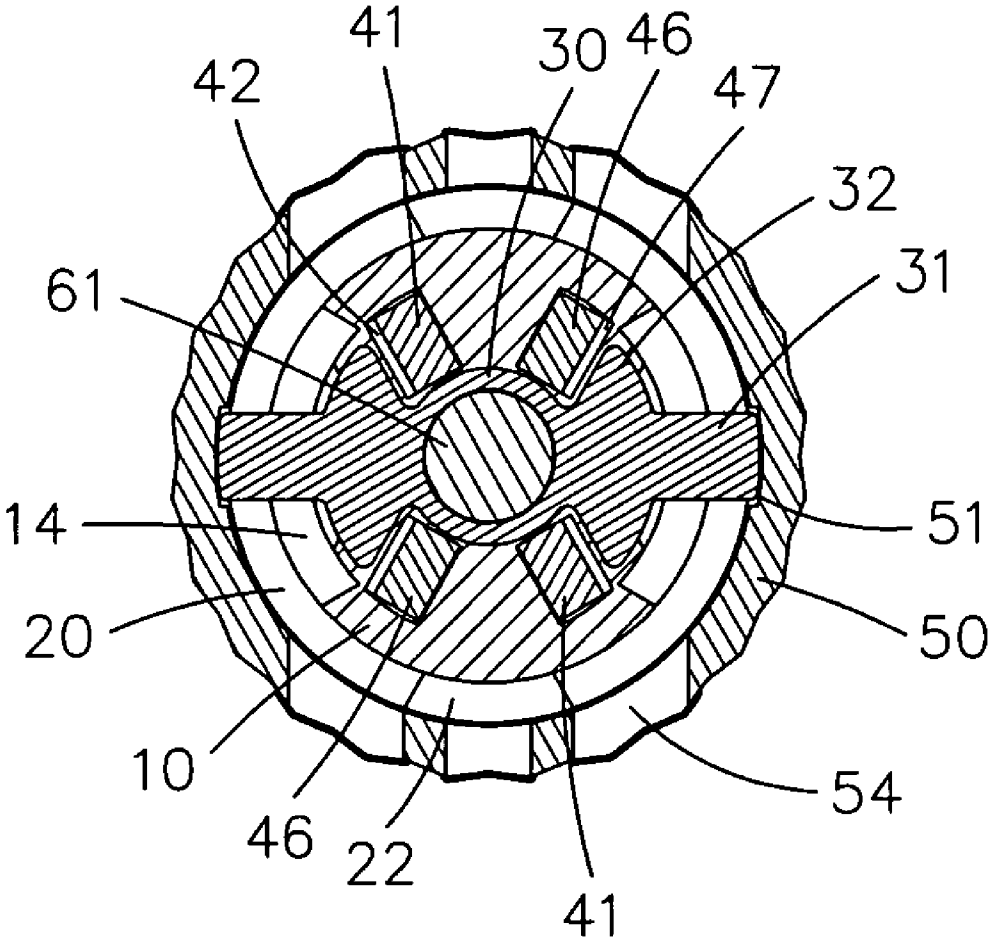
FIG. 4 is a plan cross-sectional view of the screwdriver taken along line 4—4 as shown in FIG. 3.

Referring to FIGS. 1–4, when the press member 30 is rotated by the rotation disk 50 to the position as shown in FIG. 4, the press portion 32 of the press member 30 is detached from the limit member 41 and 46 of each of the first and second limit units 40 and 45, so that the limit member 41 and 46 of each of the first and second limit units 40 and 45 is positioned in the respective positioning groove 62 of the positioning member 60 as shown in FIG. 3. Thus, the positioning member 60 is secured to and rotated by the mounting seat 10, so that the handle 80 can be rotated to drive the screwdriver tip 90 to rotate in the clockwise and counterclockwise directions. At this time, the user can watch the indicating plate 22 of the annular sleeve 20 through the indication windows 54 of the rotation disk 50 to judge the operation direction of the screwdriver.

Figure 5:
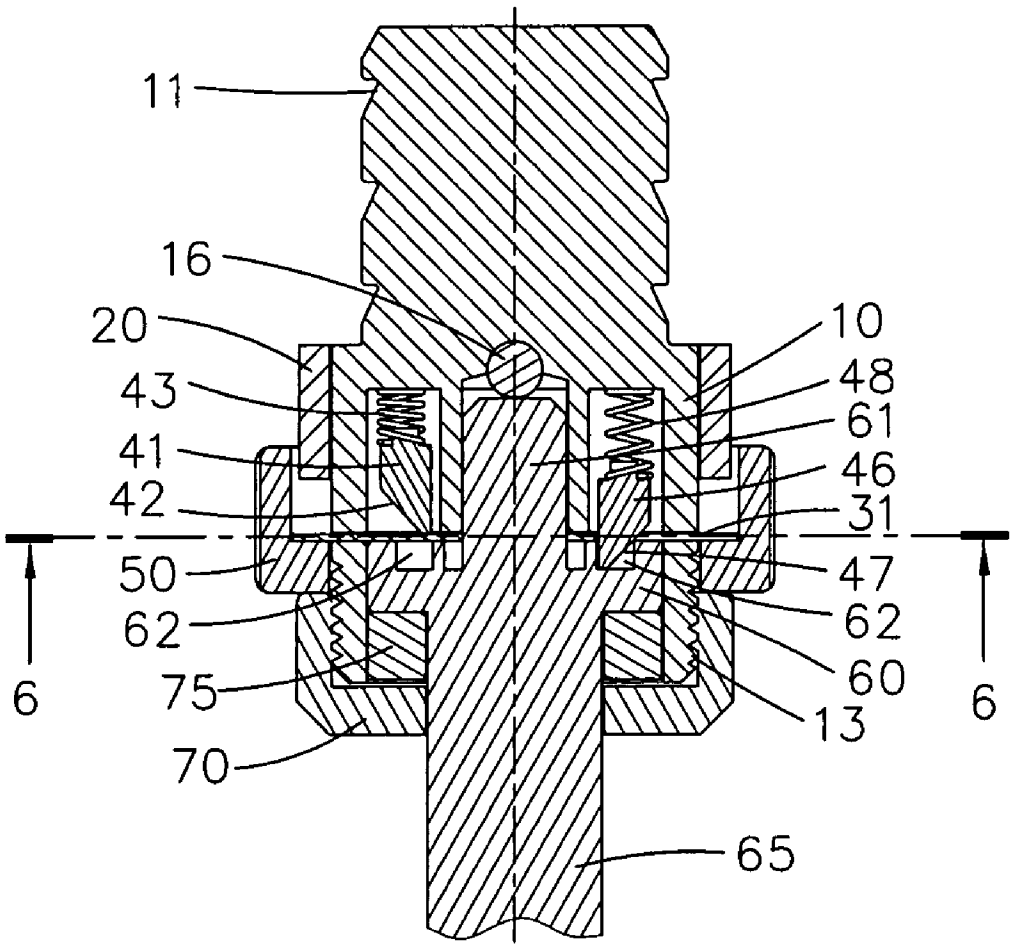
FIG. 5 is a schematic operational view of the screwdriver as shown in FIG. 3.
Figure 6:
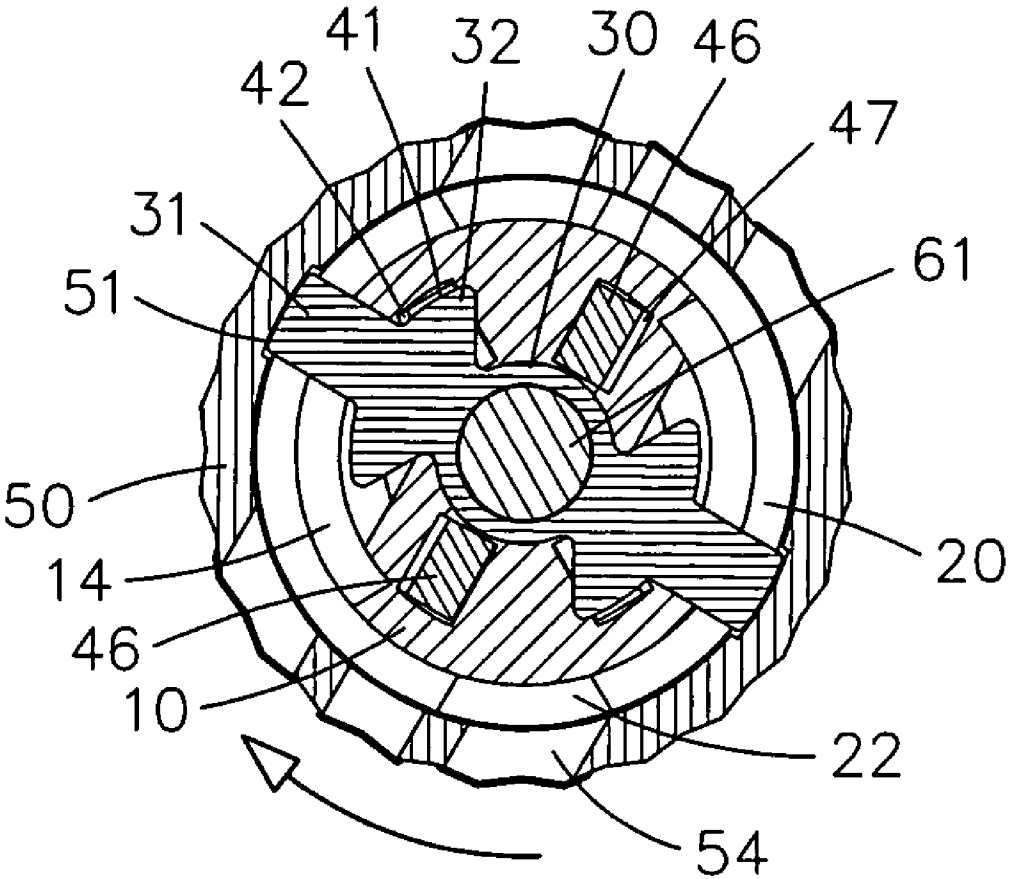
FIG. 6 is a plan cross-sectional view of the screwdriver taken along line 6—6 as shown in FIG. 5.

Referring to FIGS. 5 and 6 with reference to FIGS. 1–4, when the press member 30 is rotated by the rotation disk 50 to the position as shown in FIG. 6, the press portion 32 of the press member 30 presses the limit member 41 of the first limit unit 40 to detach from the respective positioning groove 62 of the positioning member 60 to detach the first limit unit 40 from the positioning member 60 as shown in FIG. 5.

In such a manner, when the handle 80 is rotated in the clockwise direction as shown in FIG. 6, the limit member 46 of the second limit unit 45 is positioned in the respective positioning groove 62 of the positioning member 60 as shown in FIG. 5, so that the positioning member 60 is secured to and rotated by the mounting seat 10, and the handle 80 can be rotated to drive the screwdriver tip 90 to rotate in the clockwise direction. On the contrary, when the handle 80 is rotated in the counterclockwise direction, the limit member 41 of the first limit unit 40 is detached from the respective positioning groove 62 of the positioning member 60 as shown in FIG. 5 to form an idle rotation, so that the handle 80 idles in the counterclockwise direction.

Thus, the handle 80 can be rotated to drive the screwdriver tip 90 to rotate in the clockwise direction only. At this time, the user can watch the indicating plate 22 of the annular sleeve 20 through the indication windows 54 of the rotation disk 50 to judge the operation direction of the screwdriver.

Figure 7:
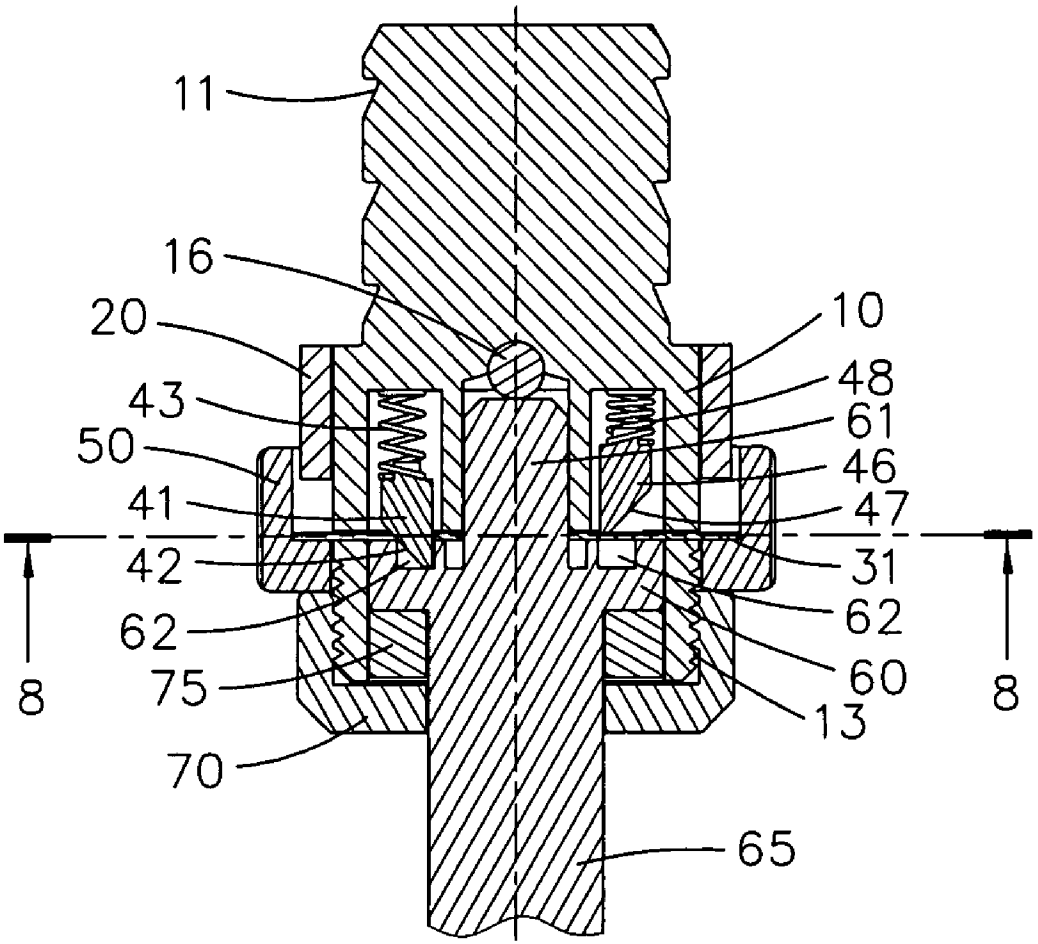
FIG. 7 is a schematic operational view of the screwdriver as shown in FIG. 3.
Figure 8:
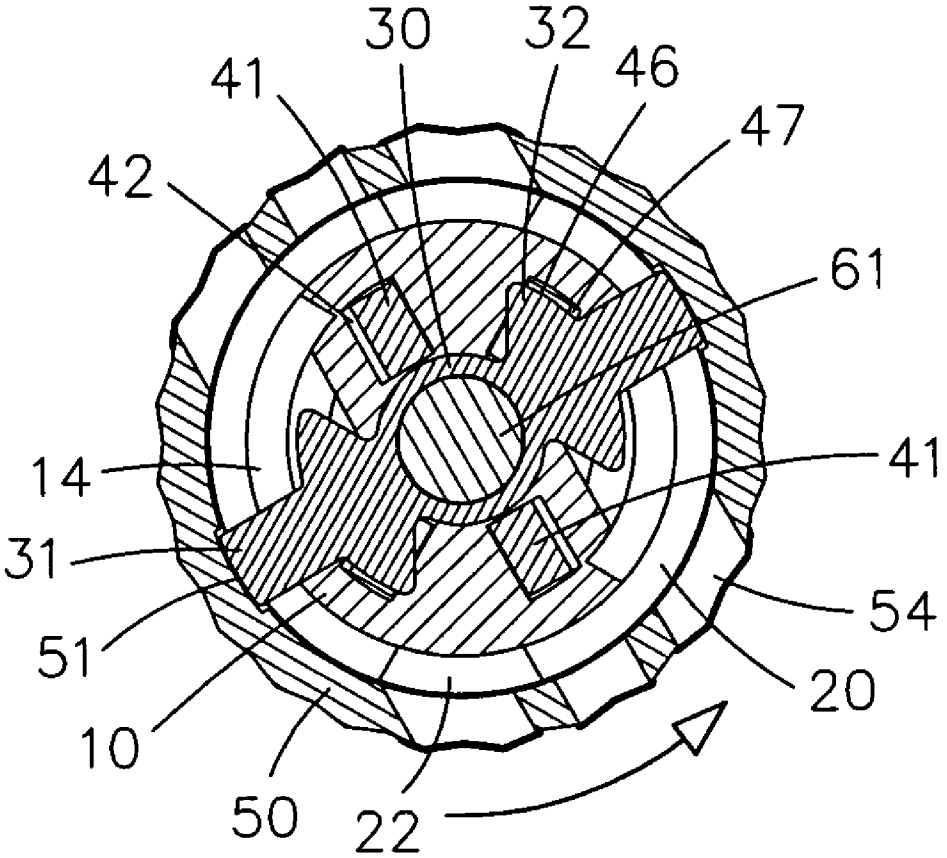
FIG. 8 is a plan cross-sectional view of the screwdriver taken along line 8—8 as shown in FIG. 7.

Referring to FIGS. 7 and 8 with reference to FIGS. 1–4, when the press member 30 is rotated by the rotation disk 50 to the position as shown in FIG. 8, the press portion 32 of the press member 30 presses the limit member 46 of the second limit unit 45 to detach from the respective positioning groove 62 of the positioning member 60 to detach the second limit unit 45 from the positioning member 60 as shown in FIG. 7.

In such a manner, when the handle 80 is rotated in the counterclockwise direction as shown in FIG. 8, the limit member 41 of the first limit unit 40 is positioned in the respective positioning groove 62 of the positioning member 60 as shown in FIG. 7, so that the positioning member 60 is secured to and rotated by the mounting seat 10, and the handle 80 can be rotated to drive the screwdriver tip 90 to rotate in the counterclockwise direction. On the contrary, when the handle 80 is rotated in the clockwise direction, the limit member 46 of the second limit unit 45 is detached from the respective positioning groove 62 of the positioning member 60 as shown in FIG. 7 to form an idle rotation, so that the handle 80 idles in the counterclockwise direction.

Thus, the handle 80 can be rotated to drive the screwdriver tip 90 to rotate in the counterclockwise direction only. At this time, the user can watch the indicating plate 22 of the annular sleeve 20 through the indication windows 54 of the rotation disk 50 to judge the operation direction of the screwdriver.

Accordingly, the handle 80 can be rotated to drive the screwdriver tip 90 to rotate in two opposite directions and to rotate in one direction only, thereby facilitating a user operating the screwdriver tip 90. In addition, the user can watch the indicating plate 22 of the annular sleeve 20 through the indication windows 54 of the rotation disk 50 to judge the operation direction of the screwdriver. Further, the user only needs to rotate the rotation disk 50 to change the operation direction of the screwdriver, thereby facilitating the user operating the screwdriver. Further, the first and second limit units 40 and 45 are arranged in an axial direction of the mounting seat 10, thereby greatly saving the space occupied by the first and second limit units 40 and 45. Further, the first and second limit units 40 and 45 can limit the operation direction of the screwdriver exactly, thereby facilitating the user operating the screwdriver.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A screwdriver, comprising a clutch mechanism, a handle mounted on a first end of the clutch mechanism, and a replaceable screwdriver tip mounted on a second end of the clutch mechanism, wherein:

the clutch mechanism includes a mounting seat, an annular sleeve, a positioning member, first and second limit units, a press member, a rotation disk, and a threaded sleeve, wherein:

the mounting seat has an inside formed with a receiving chamber and has a peripheral wall formed with two radially opposite guide slots, the receiving chamber of the mounting seat has a bottom wall having a periphery formed with a plurality of receiving recesses;

the annular sleeve is mounted on the mounting seat;

the positioning member is mounted in the receiving chamber of the mounting seat and has a periphery formed with a plurality of positioning grooves;

each of the first and second limit units includes at least one limit member movably mounted in the respective receiving recess of the mounting seat and detachably positioned in the respective positioning groove of the positioning member, and at least one elastic member mounted in the respective receiving recess of the mounting seat and biased between the limit member and the mounting seat to push the limit member toward the positioning member;

the press member is rotatably mounted in the mounting seat, the press member is extended through and rotatably mounted in the guide slots of the mounting seat, the press member has two opposite ends each having a first portion located in the receiving chamber of the mounting seat and formed with at least one outwardly extending press portion that is movable to press the limit member of each of the first and second limit units;

the rotation disk is rotatably mounted on the mounting seat and secured to the press member to rotate the press member;

the threaded sleeve is mounted on the mounting seat and rested on the rotation disk to limit the rotation disk on the mounting seat.

2. The screwdriver in accordance with claim 1, wherein the bottom wall of the receiving chamber of the mounting seat has a central portion formed with a socket, and the positioning member has a first side formed with a plug inserted into the socket of the mounting seat.

3. The screwdriver in accordance with claim 2, wherein the clutch mechanism further includes a ball mounted in the socket of the mounting seat and located between the plug of the positioning member and the mounting seat, so that the positioning member is rotatable smoothly and conveniently.

4. The screwdriver in accordance with claim 3, wherein the socket of the mounting seat has a bottom formed with a notch, and the ball is received in the notch of the mounting seat.

5. The screwdriver in accordance with claim 1, wherein the mounting seat has an end face formed with a serrated mounting portion having a reduced diameter for mounting the handle.

6. The screwdriver in accordance with claim 1, wherein the end face of the mounting seat has a periphery formed with at least one locking groove, and the annular sleeve has an inner wall formed with at least one locking block inserted into the locking groove of the mounting seat to secure the annular sleeve to the mounting seat.

7. The screwdriver in accordance with claim 1, wherein the peripheral wall of the mounting seat is formed with an outer thread, and the threaded sleeve is screwed onto the outer thread of the mounting seat.

8. The screwdriver in accordance with claim 2, wherein the positioning member has a second side formed with an extension tube having a distal end formed with a hexagonal insertion hole to allow insertion of the screwdriver tip.

9. The screwdriver in accordance with claim 8, wherein the threaded sleeve has an inside formed with a through hole to allow passage of the extension tube of the positioning member.

10. The screwdriver in accordance with claim 8, wherein the clutch mechanism further includes a bearing mounted between the positioning member and the mounting seat so that the positioning member is rotatable relative to the mounting seat.

11. The screwdriver in accordance with claim 10, wherein the bearing is mounted around the extension tube of the positioning member and retained by the threaded sleeve to retain the positioning member in the mounting seat.

12. The screwdriver in accordance with claim 1, wherein the limit member of each of the first and second limit units has an oblique guide face, and the press portion of the press member is movable to press the oblique guide face of each of the first and second limit units.

13. The screwdriver in accordance with claim 12, wherein the oblique guide faces of the first and second limit units are directed toward different directions.

14. The screwdriver in accordance with claim 1, wherein each of the two opposite ends of the press member has a second portion protruded outward from the respective guide slot of the mounting seat and formed with an insertion portion, and the rotation disk has an inner wall formed with two radially opposite insertion recesses to allow insertion of the insertion portions of the press member to secure the rotation disk to the press member.

15. The screwdriver in accordance with claim 1, wherein the press member is rotatable between a first position where the press portion of the press member is detached from the limit member of each of the first and second limit units and a second position where the press portion of the press member presses the limit member of either of the first and second limit units to detach from the respective positioning groove of the positioning member so as to detach either of the first and second limit units from the positioning member.

16. The screwdriver in accordance with claim 1, wherein the annular sleeve has a side formed with at least one protruding indicating plate rested on the peripheral wall of the mounting seat to indicate an operation direction of the screwdriver.

17. The screwdriver in accordance with claim 16, wherein the inner wall of the rotation disk is formed with at least one slideway, and the indicating plate of the annular sleeve is slidable in the slideway of the rotation disk.

18. The screwdriver in accordance with claim 17, wherein the rotation disk has a periphery formed with a plurality of indication windows extended into the slideway and aligned with the indicating plate of the annular sleeve, so that a user can watch the indicating plate of the annular sleeve through the indication windows of the rotation disk to judge the operation direction of the screwdriver.

19. The screwdriver in accordance with claim 1, wherein the rotation disk is located outside of and rotatable relative to the annular sleeve.

20. The screwdriver in accordance with claim 1, wherein the rotation disk has an outer wall formed with a plurality of anti-slip portions to facilitate a user rotating the rotation disk.

* * * * *